United States Patent [19]

Lotspeich et al.

[11] 4,368,829

[45] Jan. 18, 1983

[54] CAN DISPENSING UNIT FOR SPIRAL VENDOR

[75] Inventors: Joseph A. Lotspeich, Inver Grove Heights; Douglas G. Lennartson, Coon Rapids, both of Minn.

[73] Assignee: Gross-Given Manufacturing Company, St. Paul, Minn.

[21] Appl. No.: 153,406

[22] Filed: May 27, 1980

[51] Int. Cl.[3] ..... G07F 11/30; G07F 11/36

[52] U.S. Cl. ..... 221/75; 221/129; 221/301

[58] Field of Search ..... 221/75, 129, 197, 198, 221/295, 301, 123, 124, 133

[56] References Cited

U.S. PATENT DOCUMENTS 2,260,643 10/1941 Rosan ..... 221/295 X
2,304,455 12/1942 Guerard ..... 221/129
2,956,660 10/1960 Nordquist ..... 221/301 X
3,737,071 6/1973 Offutt et al. ..... 221/129
3,773,217 11/1973 Schlaf ..... 221/75
4,061,245 12/1977 Lotspeich ..... 221/75

*Primary Examiner*—F. J. Bartuska
*Attorney, Agent, or Firm*—Merchant, Gould, Smith, Edell, Welter & Schmidt

[57] ABSTRACT

An auxiliary can dispensing unit (30) for use in vending machine (2) comprises an inclined track (32). Pivotal control member (62) at the discharge end (34) of track (32) dispenses a single can (42) at a time. Pivotal control member (62) is actuated by a cam (78) and connecting rod (98) which are releasably secured to the output shaft (20) of a motor. The inclined track (32) is releasably contained in dispensing channel (10) of vending machine (2) and is meant to replace the helical coil (14) normally used therein.

8 Claims, 6 Drawing Figures

FIG. 1
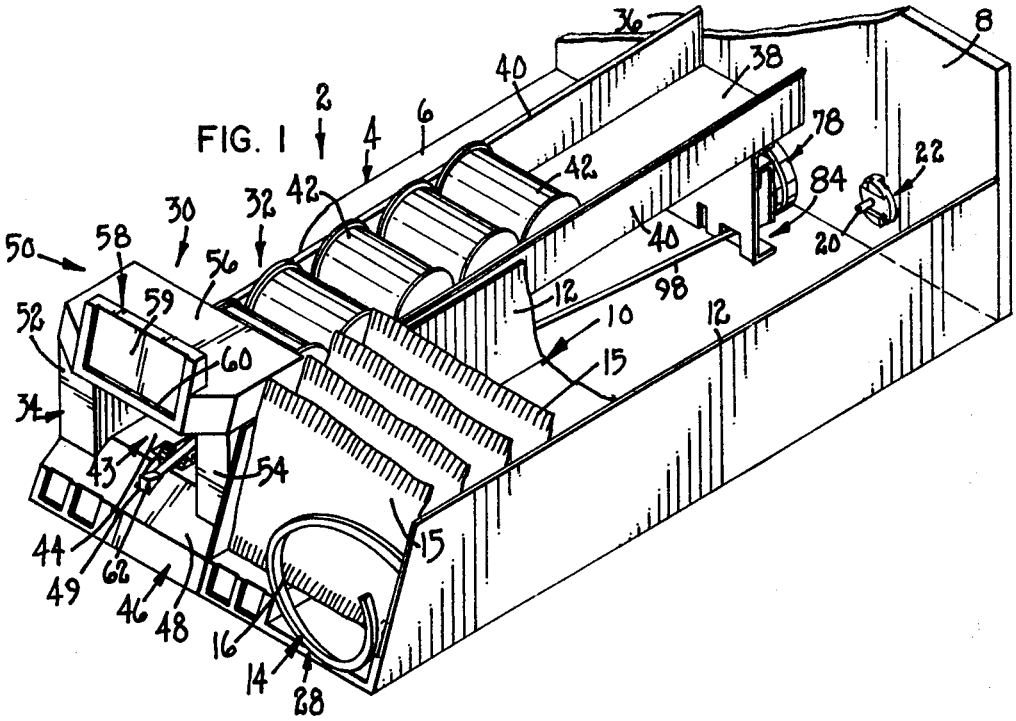
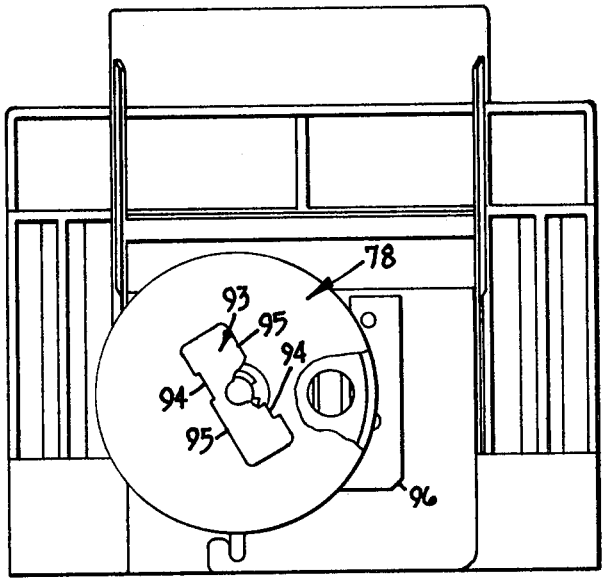
FIG. 2

FIG. 4
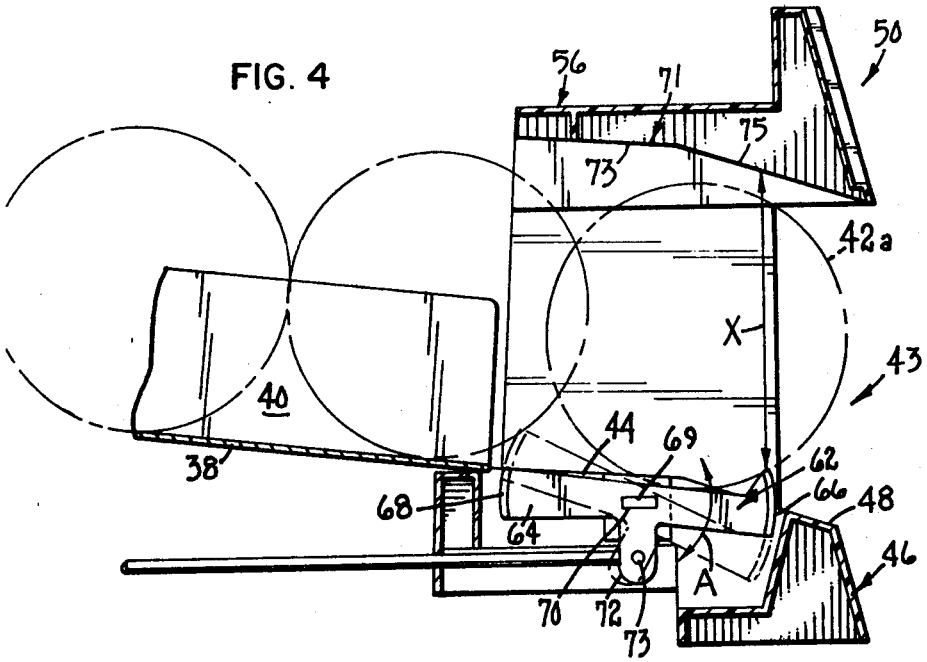
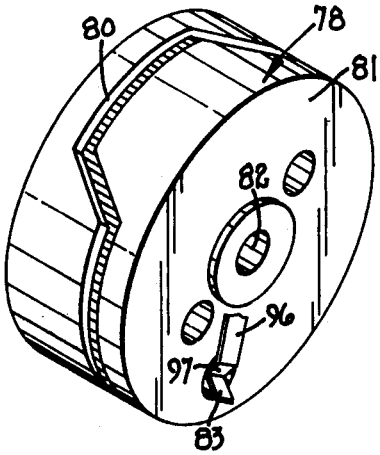
FIG. 5
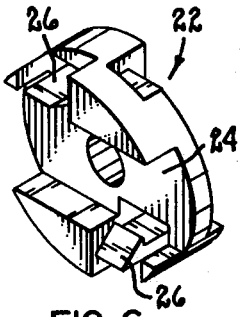
FIG. 6

CAN DISPENSING UNIT FOR SPIRAL VENDOR

TECHNICAL FIELD

This invention relates in general to automatic vending machines for dispensing food products and similar articles. More particularly, this invention relates to a vending machine of the helical coil type having means for dispensing cans of soup or other similarly shaped products.

DESCRIPTION OF THE PRIOR ART

Automatic vending machines are well-known that dispense selected food products. Various dispensing mechanisms are used depending on the types of food products being vended. One well-known class of such vending machines are those known in the trade as helical coil vending machines, or alternatively, as spiral vendors. These machines are widely used for dispensing pre-packaged food products such as pastries, potato chips, candy bars, etc.

Helical coil dispensing machines customarily include a housing containing a plurality of vertically spaced shelves. A plurality of elongated dispensing coils extend from front to back on each shelf. Each of the dispensing coils is contained between opposed side walls in a dispensing channel. The rear end of each dispensing coil is connected to an electric motor for rotating the coil. The motor is selectively operated by actuation of the proper selection button.

Each of the coils contains a plurality of food products received between the convolutions of the coil. These food products ride along the surface of the shelf and are moved forwardly in a step-by-step manner by consecutive rotations of the coil. Eventually, the products are pushed over the forward edge of the shelf. The products so dispensed fall down through a discharge space in front of the shelves into a discharge bin. There the products are manually removed by the purchaser.

Helical coil dispensing machines are suitable for dispensing many products. They are not normally suitable for dispensing canned products, such as soup cans, juice cans, and the like. Such canned products are too bulky to fit between the convolution of the dispensing coil. They, therefore, cannot be dispensed using a helical coil.

Vending machine are often grouped together in a particular vending location. This location also often includes tables for the customers to sit at and a microwave oven for heating soup cans, sandwiches, etc. It is desirable to be able to vend canned soup or other canned products at this location since many people wish to purchase such products. Because a helical coil vending machine is unable to vend canned products, a separate vending machine, designed primarily for dispensing these products, is usually provided.

The use of a separate vending machine for canned products is disadvantageous. Two separate vending machines are required to vend both flexibly packaged and canned products. This increases both the expense of setting up the vending machine installation as well as the expense of maintaining and operating the machines. It would be more desirable if a helical coil vending machine could be made to vend canned products.

To the best of Applicant's knowledge, there has been one helical coil vending machine that has been able to vend canned products. That machine has been marketed under the tradename Vendo. It includes a permanently mounted inclined track on which the soup cans are stored single file. An elongated shaft runs beneath the inclined track and is coupled to a drive means at the rear of the track. Two half cams are provided at the front of the shaft which extend in opposite directions, i.e. one cam extends up when the other extends down. These half cams represent blocking members which allow the dispensing of a single canned product upon rotation of the shaft. For example, when the first half cam is in a position to block the first can on the track, the second half cam is rotated out of the way of the other cans on the track. Rotation of the shaft to remove the first cam from the blocking position will cause the second cam to be interposed in front of the remaining cans on the track. The first can rolls off the track to be dispensed while the other cans are held in place by the second cam.

While the above-noted vending machine does address itself to the problem of using a spiral vendor for vending canned products, it has a number of disadvantages. First, the inclined tracks, to the best of Applicant's knowledge, are permanently mounted in the vending machine. Not all vending installations require spiral vendors having a can dispensing ability. Placing such a machine in these intallations wastes vending capacity since the inclined can dispensing tracks are never used. Thus, the use of permanently mounted inclined tracks is disadvantageous in some situations.

In addition, the use of a shaft and the two half cams for dispensing one can at a time is relatively complex and cumbersome. Suitable bearings must be provided to journal the drive shaft beneath the inclined track. The two cams are relatively bulky. In addition, the drive shaft itself represents a considerable amount of mass. Sufficient (and not insignificant) power must be used to rotate the combined mass of the shafts and the cams. In addition, the cams are difficult to repair or replace if for some reason they should fail, especially since they are beneath the permanently mounted inclined track.

SUMMARY OF THE INVENTION

Accordingly, this invention relates to an auxiliary can dispensing unit and to a helical coil vending machine having at least one such auxiliary can dispensing unit that obviates some of the above-noted disadvantages of the prior art. More particularly, the vending machine of this invention utilizes replaceable can dispensing units that can be inserted into the dispensing channels of the vending machine in place of the helical coils normally contained there. In addition, the invention uses a control member for dispensing the cans one by one which is relatively simple, easily replaceable, and requires little power to operate.

A plurality of dispensing coils are located repectively in dispensing channels in the housing. Each coil has a plurality of convolutions between which a plurality of products to be vended are received. Each coil further has a discharge end which is spaced from one wall of the housing to define a discharge space into which each of the products contained in the coil may be ejected. Motor means, which extend into each of the dispensing channels, are releasably connected to each of the dispensing coils for rotating the coils in a dispensing direction.

One aspect of this invention is the use of an auxiliary can dispensing unit which can be selectively used in any of the dispensing channels in place of the helical coil therein. This can dispensing unit comprises an inclined track which slopes upwardly from a discharge end and is of sufficient width to allow the cans to be stacked one behind the other such that the cans roll down the track towards the discharge end. A dispensing means is located at the discharge end of the track for dispensing one can at a time. Furthermore, means are provided for coupling the dispensing means to the motor means extending into the dispensing channel such that rotation of the motor means will actuate the dispensing means. This connecting means is releasable from the motor means and the inclined track is releasable from the housing to allow the can dispensing unit to be easily removed from or installed in the dispensing channel.

Another aspect of this invention relates to the use of a pivotal control member for the dispensing means. The pivotal control member has first and second can stops spaced apart in the direction of the longitudinal tracks. The control member is pivotal about a substantially horizontal axis from a first position, in which the first can stop is interposed into the path of the first can to prevent the first can from moving off the end of the track, to a second position, in which the first can stop is removed from engagement with the first can to dispense that can with the second can stop being moved upwardly to a position in front of the remaining cans on the track to prevent them from being dispensed with the first can. Thus, only one can at a time is dispensed during pivotal movement of the control member from its first to its second position.

BRIEF DESCRIPTION OF THE DRAWINGS

This invention will be fully described in the Detailed Description, when taken in conjunction with the following drawings, in which like reference numerals refer to like elements throughout.

FIG. 1 is a perspective view of an auxiliary can dispensing unit according to this invention, particularly illustrating that can dispensing unit placed in one of the dispensing channels of a helical coil vending machine;

FIG. 2 is a rear elevational view of the can dispensing unit shown in FIG. 1;

FIG. 4 is a partial cross-sectional view of the can dispensing unit shown in FIG. 1, taken along lines 4—4 of FIG. 1, particularly illustrating the dispensing means of the can dispensing unit;

FIG. 5 is a perspective view of the dispensing cam of the can dispensing unit shown in FIG. 1; and FIG. 6 is a perspective view of a cross bracket holding member which forms a portion of the connecting means for releasably coupling the dispensing means to the motor means.

DETAILED DESCRIPTION

Figure 3:
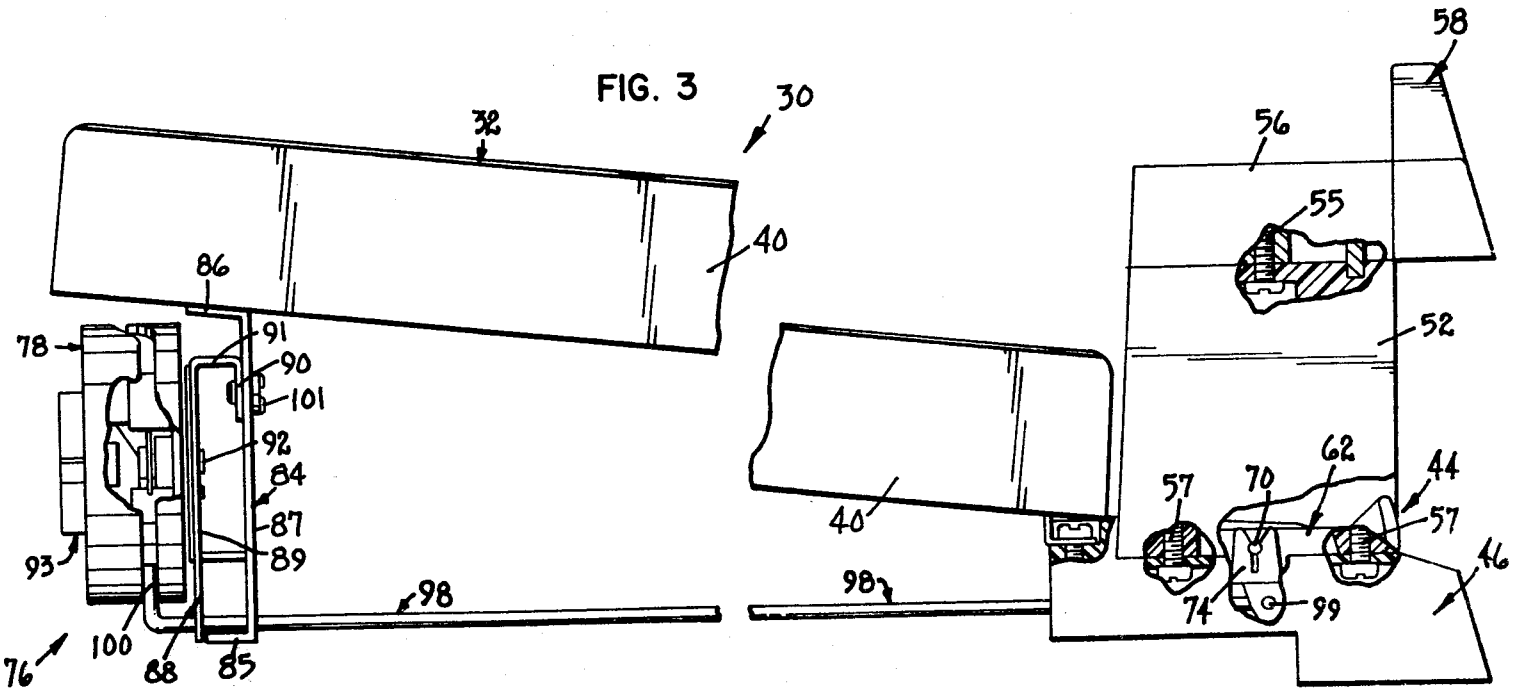
FIG. 3 is a side elevational view of the can dispensing unit shown in FIG. 1, with certain parts thereof being broken away and other parts shown in cross-section to better illustrate the construction of the can dispensing unit.

Referring first to FIG. 1, a portion of an improved vending machine according to this invention is generally illustrated as 2. Vending machine 2 is preferably of the type disclosed in U.S. Pat. No. 4,061,245, issued Dec. 6, 1977, to Joseph A. Lotspeich and assigned to the assignee of the present application. The above-noted patent is hereby incorporated by reference. This patent discloses various details of vending machine 2 which are not important for an understanding of the present invention. Vending machine 2 will be described herein only insofar as is necessary for a background to and an understanding of the present invention. Further reference may be had to the above-noted patent for other details of vending machine 2.

Referring to FIG. 1, one shelf of the vending machine is generally indicated as 4. The vending machine has a substantially rectangular housing closed by an openable front door. A plurality of shelves identical to shelf 4 are vertically located in a spaced apart orientation of the housing. The construction of each shelf is generally similar so that a description of one shelf 4 will suffice to describe the others.

Shelf 4 includes a substantially horizontal upper shelf surface 6 having an upwardly extending rear wall 8. Shelf 4 is divided into a plurality of product receiving tracks or dispensing channels 10 by a plurality of longitudinal vertical members or walls 12. Walls 12 run the entire length of shelf 4 from rear wall 6 to the front edge thereof. Walls 12 are laterally spaced apart a sufficient distance to define a dispensing channel 10 in which a first normal sized elongated helical coil 14 is received.

Each helical coil 14 has a plurality of convolutions and a generally circular cross-section. As shown in FIG. 1, various food products 15, such as bags of potato chips, are normally received between the convolutions of the coil. Food products 15 slide along shelf surface 6. Each coil 14 terminates near the front edge of shelf 4 in a discharge end 16 and at the rear end of shelf 4 adjacent rear wall 8 in a driven end. The discharge end 16 of all the coils in the vending machine are appropriately spaced from the front wall of the vending machine to provide a discharge space into which food products 15 can be vended.

A separate motor (not shown) is provided for rotating each of the helical coils 14 in a direction to allow dispensing of the food products 15 received between the convolutions therein. Each of the motors is secured (e.g., be screws or the like) to the rear side of rear wall 8. Each motor has a shank or output shaft 20 which extends through rear wall 8 and into the rear of each product receiving channel 10.

The rear or driven ends of each of the helical coils 14 are provided with any suitable means for releasably attaching to shank 20 of the motor. One particular form of releasable connection may be that shown in the abovementioned U.S. patent. In that connection, the driven end of each coil 14 is welded or otherwise fixedly attached to a U-shaped cross bracket. This cross bracket (not shown) has two opposed semi-circular slots. The connection also includes a cross bracket holding member 22 which is fixedly coupled to motor shank 20 and is located at the rear of dispensing channel 10 in front of side wall 8. Cross bracket holding member 22 has a channel 24 which receives therein the U-shaped cross bracket on the driven end of coil 14. A plurality of spring biased retaining clips 26 on cross bracket holding member 22 detachably clip into the semi-circular slots on the cross bracket. This detachably couples coil 14 to motor shank 20 since the holding power of clips 26 is sufficient to make a firm connection but is not so strong so as to prevent the coil 14 from being disengaged with the cross bracket holding member 22 simply by pulling coil 14 forwardly in dispensing channel 10. Though a particular type of connection has been illustrated herein, any easily releasable connection could be used.

Coils 14 when coupled to the motor shank 20 are positioned relative to the upper surface 6 of shelf 4 so that the driven end is supported above shelf surface 6. The shelf surface 6 terminates in a front edge 40 which is spaced from the door of the vending machine housing to define a discharge space. The discharge end 16 of coil 14 is supported above shelf surface 6 by a front coil support apparatus 28. Coil support apparatus 28 is preferably of the type shown in the above-referenced U.S. patent or of the type shown in U.S. Pat. No. 4,148,412 issued to Joseph A. Lotspeich on Apr. 10, 1979, and which is also incorporated by reference. Coil support members 28 are attached to the front edge of shelf 6 by threaded securing members, such as screws, which pass upwardly through the underside of shelf 6 into threaded bores in the coil support members.

This invention relates to a can dispensing unit, generally illustrated as 30, that is selectively usable in vending machine 2. More particularly, can dispensing unit 30 includes an inclined track or product trough 32. Track 32 slopes upwardly from a discharge end 34 to a rear end 36. Track 32 comprises a bottom wall 38 and spaced upwardly extending side walls 40. Side walls 40 are laterally spaced apart a sufficient distance to allow canned products, generally indicated as 42, to be stacked one behind the other in single file between the side walls 40. Because of the slope of track 32, cans 42 will roll downwardly towards discharge end 34.

Referring now particularly to FIGS. 3 and 4, a dispensing means 43 for dispensing one can at a time is located at discharge end 34 of track 32. A dispensing member 46 defines the discharge end 34 of track 32. Preferably, dispensing member 46 includes a dispensing surface 44 which slopes slightly downwardly and which generally matches the inclination of bottom wall 38 of track 32. In addition, a downwardly sloped ramp portion 48 is adjacent to and integrally formed with dispensing surface 44. Dispensing member 46 is releasably secured to the front edge of shelf surface 6 by a plurality of threaded securing members, such as screws, which pass upwardly through shelf surface 6 and into threaded bores on the underside of dispensing member 46. In this regard, the method of attaching dispensing member 46 to shelf 4 is similar to the method of attaching coil support apparatus 28.

Dispensing member 46 further includes a U-shaped bridge 50 which extends up over dispensing means 42. Bridge 50 comprises left and right side walls or columns 52 and 54 that support a cross beam or upper rail 56. Preferably, threaded securing members, such as screws 57, secure side walls 52 and 54 to dispensing member 46. Threaded securing members, such as screws 55, then releasably secure upper rail 56 to the side walls 52 and 54. (See FIG. 3) The upper rail 56 includes a display panel 58 that faces forwardly. Display panel 58 has a recess 59 that includes indented lips 60 extending around the side and bottom edges thereof. Lips 60 will retain a card or label in recess 59. The card or label preferably contains information describing what products are being vended by unit 30. The card or label is simply slid into recess 59 by dropping it downwardly from the top with the side edges of the card engaged between opposed lips 60.

Dispensing means 42 comprises a pivotal control member 62. Control member 62 includes a body 64 having a first can stop 66 at the front end and a second can stop 68 at the rear end. Body 62 includes horizontal wings or flanges 69 which extend to both sides of body 64 and which terminates in two outwardly extending pivot pins 70. Pivot pins 70 are colinear and define a substantially horizontal pivot axis for control member 62. In addition, control member 62 includes a downwardly extending arm 72 beneath wings 69. Arm 72 includes an aperture 73 for a purpose which will be described hereafter.

The dispensing member 46 includes a generally cross shaped recess 49 in dispensing surface 44 and ramp portion 48. Recess 49 includes upwardly extending forks 74 in the lateral portions of the cross. Forks 74 relesably engage the pivot pins 70 of control member 62 with a snap-fit. Control member 62 is received in cross shaped recess 49 with the body 64 extending along the longitudinal axis of the cross and the wing shaped portions 69 extending out into the lateral portions of the cross with the pivot pins 70 being snapped into forks 74. Pivot pins 70 are rotatably received in forks 74 to pivotably journal control member 62 therein. When so installed in recess 49, the first and second stops 66 and 68 are spaced apart along the longitudinal axis of the track 38.

Control member 62 is pivotal about the substantially horizontal axis defined by pivot pins 70. A first position of the control member 62 is illustrated in solid lines in FIG. 4. In this position, the first can stop 66 is interposed in front of the first can **42*a* contained in the line of cans in inclined track 38. This prevents any of the cans 42 from being discharged. However, when control member 62 is pivoted in the direction indicated by the arrow A to a second position shown in phantom in FIG. 4, the first can stop 66 is moved downwardly to clear the first can 42*a* and the second can stop 68 is moved upwardly so that it blocks all of the remaining cans in the inclined track 48 except for the first can 42*a*. This allows the first can 42*a* to roll off the dispensing surface 44 and ramp 48 of dispensing member 46. Can 42*a* then falls down through the discharge space of vending machine 2** to be vended.

Referring again to FIG. 4, upper rail 56 of bridge 50 includes a can confining surface 71. Can confining surface 71 is a longitudinally extending wall or flange which is molded or otherwise integrally formed in the underside of upper rail 56. Can confining surface 71 has a first sloped portion 73 and a second sloped portion 75 which respectively mirror the slopes of dispensing surfaces 44 and 48. The perpendicular distance between the tip of first can stop 66 when control member 62 is in its first position and the second sloped portion 75 of the can confining surface 71 is labelled and illustrated as X in FIG. 4. This distance X is chosen to be less than the diameter of the can 42 being vended. This prevents the cans from riding up over the first can stop 66 and possibly even being accidentally vended.

A connecting means 76 is provided for releasably connecting control member 62 to the output shaft or shank 20 of the motor at the rear of one dispensing channel 10. Referring to FIG. 5, this connecting means 76 comprises a dispensing cam 78. Cam 78 is generally cylindrical and includes a cam track 80 in the outer peripheral surface thereof. The inner side or face 81 of dispensing cam 78 includes a bore 82 along the axis of cam 78. Inner face 81 also includes an aperture 83 which is radially offset relative to bore 82.

The rear end 36 of inclined track 32 is supported on shelf 4 by support member 84. Support member 84 is U-shaped having a horizontal bottom flange 85, a tilted upper flange 86 and a vertical wall 87 connecting the upper and lower flanges 85 and 86. Bottom wall 38 of track 32 is connected to top flange 86 in any suitable manner, e.g. by rivotting, welding or the like. The horizontal lower flange 85 simply rests on top of shelf surface 6.

A cam mounting bracket 88 rotatably journals dispensing cam 78 on support member 84. Mounting bracket 88 includes a vertical mounting wall 89 to which dispensing cam 78 is secured and a vertical flange 90 connected to mounting wall 89 by a horizontal flange 91. Vertical flange 90 is secured to support member 84 by pins or shoulder screws 101. The shank of pins 101 are preferably received in elongated slots or apertures in vertical wall 90 so that the mounting bracket 88 is relatively free-floating with respect to support member 84. In other words, mounting bracket 88 can tilt or move vertically up and down slightly with regard to support member 84. In addition, the vertical support wall 89 of mounting bracket 88 contains an outwardly extending stub shaft or the like 92 fixedly secured thereto. Stub shaft 92 is received in bore 82 of dispensing cam 78 to rotatably journal the dispensing cam.

The outer or back face of cam 78 includes a rectangular cross bracket member 93 having two small notches 94 in two opposite sides 95 thereof. Cross bracket member 93 is firmly received in the rectangular recess 24 of cross bracket holding member 22 with sides 95 being in a driving engagement with the opposed sides of recess 24. The spring biased clips 26 of member 22 extend into the recesses 94 of cross bracket member 93 for clearance and do not themselves clamp onto cross bracket member 93 as they do in the case of helical coil 14. The releasable driving connection between cam 78 and the output shaft 20 of the drive motor on which the cross bracket holding member 22 is fixed comes solely from the reception of cross bracket member 93 in recess 24. However, when dispensing unit 30 is installed in dispensing channel 10, its geometry is selected so that cross bracket member 93 is received in recess 24 with no possibility of its moving forward or slippping out. In addition, cam 78 free floats relative to support member 84 and inclined track 32, cam 78 is able to correct for misalignment with the cross bracket holding member 22 when the unit 30 is slid into a dispensing channel 10.

Cam 78 is also provided with means for locating the cam in a predetermined initial position. This position is one where control member 62 is disposed in its first position and cross bracket member 93 is generally properly located for connection to the cross bracket holding member 22. This locating means comprises a small leaf spring 96 secured to the rear side of the vertical wall 88 of support member 84. Leaf spring 96 has an outwardly extending tip or projection 97 which is to be releasably received in aperture 83 of cam 78. When projection 97 is received in aperture 83, cam 78 is properly positioned to allow the cross bracket member 93 to be coupled to the cross bracket holding member 22. However, the holding power of leag spring 96 is not sufficiently strong to prevent cam 78 from being rotated by output shaft 20.

A longitudinal connecting rod 98 extends between the dispensing cam 78 and control member 62. One end 99 of connecting rod 98 is releasably received in the aperture 73 in arm 72 of control member 62. The other end 100 of connecting rod 98 is received in cam track 80 of cam 78. Cam track 80 is shaped to convert rotary movement of cam 78 through 360° into a longitudinal reciprocation of connection rod 98. Longitudinal reciprocation of connecting rod 98 rotates control member 62 first from its first to its second position and then back to the second from its first position. Thus, a single longitudinal reciprocation of connecting rod 98 will dispense a single can, i.e. the first can 42*a*, from inclined track 32.

As noted earlier, the can dispensing unit 30 is an auxiliary one. This unit 30 is meant to be releasably received in any one of the dispensing channels 10 in vending machine 2. To install a can dispensing unit 30, the helical coil 14 is first removed from the dispensing channel 20. The coil support apparatus 28 is then unscrewed from the front edge of shelf 4 and removed. The can dispensing unit 30 shown in FIG. 1 is then simply slid rearwardly into the dispensing channel 10 with the side walls 40 being closely adjacent to and engaging against the side walls 12 of the dispensing channel. The rearward movement of dispensing unit 30 continues until the inclined track 32 abuts up against the rear wall 8 and the cam 78 is releasably connected to the cross bracket holding member 22. When this occurs, dispensing member 46 is then in a proper position along the front edge of shelf 4 to be releasably secured thereto using screws. These screws extend upwardly into dispensing member 46 in the same manner as the screws which held the coil support apparatus 28 to shelf 4.

Once the dispensing unit is so installed, dispensing of canned products 42 then occurs in the same manner as the dispensing of other products. In other words, the purchaser who wishes to purchase a canned product will insert an appropriate amount of money into the vending machine. He will then actuate a selection button which corresponds to the can dispensing unit 30. This actuation will cause the motor to rotate cam 78 through 360°. This rotation causes the pivotal movement of the control member 62 which dispenses the first can 42*a* on track 32. This can 42*a* falls down through the discharge space into the discharge chute or bin (not shown) of vending machine 2. The purchaser then reaches in and removes the vended can 42*a*. Only one can 42 is dispensed during a single rotation of cam 78.

Vending machine 2 and the auxiliary dispensing unit 30 of this invention has numerous advantages. For one thing, as many can dispensing units 30 as may be needed may be placed into any vending machine 2 of this type. This allows great flexibility in using the exact number of can dispensing units 30 in machine 2 which are required at a particular vending location. Because the can dispensing unit 30 is removable and replaceable, it can also be used in previously existing vending machines 2 without the need for any retrofit modifications. Accordingly, great flexibility is given vending machine operators in terms of the capacity for vending canned products 42 at any particular location. It also allows a helical coil type of vending machine 2, which is easily suitable only for flexibly packaged products, and can be easily converted, at least partially, to the vending of canned products 42.

In addition, the use of the particular pivotal control member 62 as disclosed herein is advantageous. For one thing, the pivotal control member 62 can be easily removed and replaced since the can dispensing unit 30 is removable from the dispensing channel 10. In addition, once control member 62 is disconnected from connecting rod 98, it can be quickly and easily snapped out of the recess 49 in dispensing member 46 and replaced with a new member 62. This speeds up the repair and replacement of the can dispensing unit if for some reason control member 62 should fracture. Moreover, the simple pivotal movement of control member 62 as disclosed herein is effective in dispensing a single product at a time from the inclined track 32 without being unduly complex or heavy.

Various modifications of this invention will be apparent to those skilled in the art. For example, an auxiliary dispensing unit 30 of this type can be used to vend any type of canned products 42 whether or not the products contain food or other materials. In addition, any suitable materials may be used in the manufacture of the components of the auxiliary dispensing unit 30. For example, the inclined track 38 itself could be made from metal whereas the dispensing member 46 and bridge 50 could be made from integrally molded plastic parts. Moreover, any numbers of can dispensing unit 30 can be used in a single vending machine 2 as may be required for the particular type of location in which the machine is located. Thus, the scope of this invention is to be limited only by the appended claims.

What is claimed is:

1. An improved vending machine of the type having a housing, a plurality of dispensing coils located respectively in corresponding dispensing channels in the housing, each coil having a plurality of convolutions between which a plurality of products to be vended are received, each coil further having a discharge end which is spaced from one wall of the housing to define a discharge space into which each of the products contained in the coil are ejected, and motor means extending into each of the dispensing channels and releasably connected to each of the dispensing coils for rotating the coils in a dispensing direction; wherein the improvement relates to an auxiliary can dispensing unit which can be selectively used in any of the dispensing channels in place of the helical coil therein for dispensing canned products, wherein the can dispensing unit comprises:

(a) an inclined track having a front discharge end adjacent the discharge space and a distal rear end, wherein the inclined track slopes upwardly from the discharge end and is of sufficient width to allow the cans to be stacked one behind the other such that the cans roll down the track towards the discharge end;

(b) dispensing means located at the discharge end of the track for dispensing one can at a time from the discharge end to allow the dispensed can to fall down into the discharge space, wherein the dispensing means comprises a pivotal control member located in the inclined track adjacent the discharge end, and wherein the control member has first and second can stops spaced apart in the direction of the track, wherein the can control member is pivotal about a substantially horizontal axis from a first position in which the first stop is interposed into the path of a first can to prevent the first can from moving off the discharge end of the track, to a second position in which the first stop is removed from engagement with the first can to allow release of the first can while the second stop is moved upwardly to a position in front of the remaining cans on the track to prevent them from being dispensed with the first can, whereby only one can at a time is dispensed during movement of the control member from its first to its second position;

(c) a longitudinal connecting rod extending from the pivotal control member towards the rear end of the inclined track, wherein the connecting rod is connected to the pivotal control member at such a location that longitudinal reciprocation of the connecting rod will pivot the control member from its first to its second position and back again; and (d) a dispensing cam releasably coupled to the motor means for rotation thereby, wherein the dispensing cam includes a cam track in which one end of the connecting rod is received, and wherein the cam track is shaped such that rotation of the cam longitudinally reciprocates the connecting rod to pivot the control member, said cam further including means for locating the dispensing cam in an initial position in which the pivotal control member is in its first position for preventing the discharge of any cans from the inclined track, said locating means comprising:

(i) a leaf spring mounted on the rear end of the track;

(ii) wherein the cam includes an aperture into which the leaf spring extends when the cam is in its initial position; and (iii) wherein the leaf spring generates a holding force with the aperture which is sufficiently strong to locate and hold the cam in its first position but which is not sufficiently strong to prevent the cam from being rotated by the motor means.

2. An improved vending machine as recited in claim 1, wherein the motor means comprises a rotatable output shaft.

3. An improved vending machine as recited in claim 1, wherein the dispensing cam is supported by the inclined track and is relatively free-floating with respect to the rear end of the track such that any misalignment between the dispensing cam and the motor means can be compensated for by movement of the cam relative to the track.

4. An improved vending machine as recited in claim 1, wherein the discharge end of the inclined track includes a dispensing surface over which the cans roll as they are dispensed, wherein the dispensing means is located in the dispensing surface such that it is easily accessible from above the dispensing surface to allow easy removal and replacement of the dispensing means.

5. An improved vending machine as recited in claim 4, wherein the dispensing means comprises a pivotal control member having a substantially horizontal pivot axis, and wherein the dispensing surface includes a recess in which the control member is received, wherein the recess includes means for pivotably journalling the pivot axis with a snap fit to allow the control member to be snapped into or out of the recess for easy replacement.

6. An improved vending machine as recited in claim 4, wherein the dispensing means includes a first can stop which projects up out of the dispensing surface in a first position to block the cans from being discharged, wherein the first can stop is vertically movable to a second position to clear the cans, and further including a can confining surface located above the first can stop in its first position by a distance less than the diameter of the cans to prevent the cans from climbing over the first can stop and being accidentally discharged.

7. An improved vending machine as recited in claim 6, wherein the can confining surface is part of a U-shaped bridge which extends upwardly from the dispensing surface, wherein the U-shaped bridge has side walls between which the cans roll and an upper rail that includes the can confining surface, wherein the U-shaped bridge is releasably secured to the dispensing surface.

8. An improved vending machine as recited in claim 7, wherein the upper rail of the U-shaped bridge includes means for containing labels for identifying the contents of the canned products being dispensed.

* * * * *